US005506377A

United States Patent [19]

Hill et al.

[11] Patent Number: 5,506,377

[45] Date of Patent: Apr. 9, 1996

[54] LIMIT SWITCH CARRIER ASSEMBLY

[75] Inventors: Jason J. Hill; Stephen Nadler; Stephen J. Burton, all of St. Louis County, Mo.

[73] Assignee: Emerson Electric Co., St. Louis, Mo.

[21] Appl. No.: 134,400

[22] Filed: Oct. 12, 1993

[51] Int. Cl.[6] ..... H01H 3/16

[52] U.S. Cl. ..... 200/47; 200/501; 200/574

[58] Field of Search ..... 200/47, 501, 573, 200/574, 297, 501, 47; 29/622; 192/138, 139, 141, 142 R

[56] References Cited

U.S. PATENT DOCUMENTS

| | | | |
|---|---|---|---|
| 3,120,595 | 4/1964 | Cork et al. | 200/574 |
| 3,649,781 | 3/1972 | Johnsen et al. | 200/574 X |
| 3,721,780 | 3/1973 | Kelly et al. | 200/47 |
| 3,824,357 | 7/1974 | Brown et al. | 200/574 X |
| 3,928,740 | 12/1975 | Alsch | 200/574 |
| 4,192,398 | 3/1980 | Hunt | 200/47 X |
| 4,328,885 | 5/1982 | Zouzoulas | 200/47 X |
| 4,411,348 | 10/1983 | Fillion | 200/47 X |
| 4,572,932 | 2/1986 | Sanders | 200/501 X |
| 4,672,858 | 6/1987 | Langowski . | |
| 4,795,867 | 1/1989 | Ohi et al. | 200/501 X |
| 4,814,556 | 3/1989 | Cole | 200/574 X |
| 4,898,044 | 2/1990 | Galloway . | |
| 5,063,808 | 11/1991 | Hill . | |

FOREIGN PATENT DOCUMENTS

| | | | |
|---|---|---|---|
| 197806 | 6/1978 | Germany | 200/574 |
| 291329 | 11/1988 | Japan | 200/501 |

*Primary Examiner*—Renee S. Luebke

*Attorney, Agent, or Firm*—Polster, Lieder, Woodruff & Lucchesi

[57] ABSTRACT

A self contained limit switch assembly includes a gear box containing gears which mesh with a gear mounted on the shaft of a rotor. The gear box gears drive a cam. Limit switches, which are operatively connected to the motor's control circuit, are placed in the path of the cam to be actuated thereby. The limit switch assembly includes a housing which may be applied to an end shield of the motor, allowing the limit switch assembly to be applied optionally to any motor which may be incorporated into a product which requires use of a limit switch in the product's operation.

22 Claims, 3 Drawing Sheets

LIMIT SWITCH CARRIER ASSEMBLY

BACKGROUND OF THE INVENTION

This invention relates to limit switches for gear motors and linear actuators, and in particular, to a limit switch carrier assembly which may be optionally added to a motor.

Limit switches are applied to motors in products in which it is desired to limit some movement of the product. Gear motors and linear actuators typically operate in two directions, requiring two (2) limit switches to control the travel in each direction. Hospital beds are one example of such products. As is known, the limit switches operate to cut current to a motor after the motor completes a desired number of revolutions. The present method of incorporating limit switches in a motor involves physically building the limit switch into the motor assembly. Such prior art motors cannot, therefore, be used in products which do not require limit switches. This, as can be appreciated, severely limits the uses for which a particular motor can be used. Manufacturers must therefor stock a significantly high number of motors. They must stock both a motor with, and a motor without, the limit switch for each type of motor finding applicational use in an original equipment manufacturer's (OEM's) product. Further, should the limit switch malfunction, the limit switch and its associated gearing are difficult to repair. This may ultimately require complete removal and replacement of the whole motor assembly, even though the motor itself is still functioning properly.

The current process for assembling limit switches to motors therefore produces motor assemblies which are expensive to repair and which require substantial inventory. To our knowledge, there is no known limit switch assembly which solves either of these problems.

Summary of the Invention

It is one object of the present invention to provide an improved limit switch assembly for motors.

Another object is to provide such a limit switch assembly which may optionally be added to the motor.

Another object is to provide such a limit switch assembly which may easily be applied to, or removed from, the motor.

Another object is to provide such a limit switch assembly which is easy and economical to produce.

These and other objects will become apparent to those skilled in the art upon review of the following description and accompanying drawings.

In accordance with the invention, generally stated, a limit switch assembly for a dynamoelectric machine is provided in which an output shaft extends through an end shield of the machine. The shaft is adapted to receive a drive gear. The limit switch assembly includes a housing having a first side or bottom mountable to an end shield of the machine and a second side or top spaced from the first side to define a gear box. At least two gears are housed in the gear box. One of the gears is a driven gear which meshes with the drive gear on the shaft to be driven thereby. The second gear meshes with the driven gear. At least one cam is operatively connected to the second gear to be rotated thereby. The cam has a cam ear which defines a cam path as the cam is rotated. At least one switch is provided which has a switch button or actuator located in the cam path to be actuated by the cam as the cam is rotated. The switch is part of a circuit which supplies current to the motor and stops the flow of current to the motor when the button is depressed to stop the motor.

The switch is a normally closed switch which is opened when the switch button is depressed.

In one embodiment of the present invention, the cam and switch are housed within the gear box. The gear box includes at least two axles extending between its first and second sides. The driven gear is rotatably journaled on one of the axles and the second gear is rotatably journaled on the other axle to be operatively connected to the driven gear. The cam and second gear are preferably mounted on the same axle, the cam being operatively connected to the second gear to be rotated thereby. The gear box preferably includes a third axle extending between the top and bottom of the housing. The third axle has rotatably journaled thereon a gear thereon which meshes with the driven gear and a gear which meshes with the second gear. The first and third axles each have more than one gear rotatably mounted thereon. The gears are interconnected and have different gear ratios to drive the second gear at a slower rate than the rate at which the rotor shaft rotates.

In a second embodiment, the switch and cam are located on the top of the housing.

The housing is defined by a pair of blanks. A first blank has a middle portion and side portions to define the bottom and sides. A second portion defines the top. The blanks have locks to secure the top to the sides. The locks include at least one key formed on at least one of the second portions of the first piece and at least one opening formed in the second piece which accepts the key. The key has a neck extending outwardly from the side portion and an ear formed on an end of the neck. the ear may be rotated on the neck to hold the second piece on the first piece. The lock also includes at least one projection formed on at least one of the side portions and at least one opening formed in the second piece to accept the projection.

DESCRIPTION OF THE PREFERRED EMBODIMENT

Figure 1:
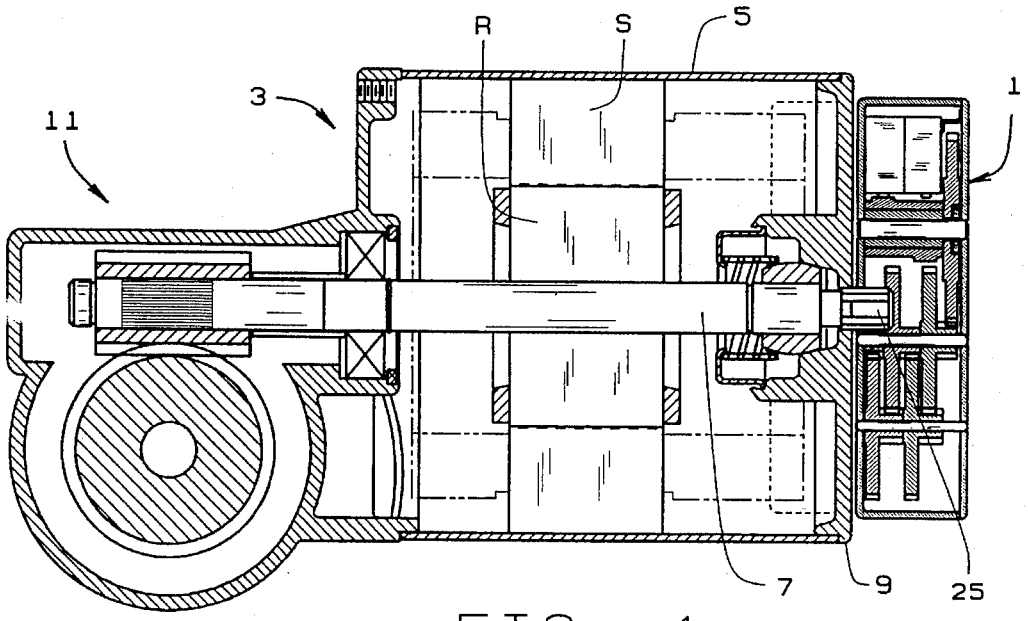
FIG. 1 is a cross-sectional view of a motor having a limit switch assembly of the present invention applied thereto.

A limit switch assembly 1 of the present invention is shown secured to a motor assembly 3 in FIG. 1. As is conventional, motor assembly 3 has a stator S and a rotor R contained in a shell 5. A rotor shaft 7 extends axially from rotor R to be rotated thereby. Shell 5 is closed at one end by an end shield 9. Motor assembly 3, as shown in FIG. 1, has a speed reducer assembly 11 at the other end of shell 5 so that the motor may be used to drive a linear actuator or other desired device.

Limit switch assembly 1 is contained in a housing 13 having a first side or bottom 15 and a second side or top 17 supported above bottom 15 by side walls 19 to define a gear box. Bottom 15 has a pair of ears 21 defining screw holes through which screws or bolts 23 extend to secure housing 13 to end shield 9. (FIG. 3) Rotor shaft 7 has a pinion gear 25 thereon which extends through both the end shield 9 and an opening 27 in housing bottom 15 to mesh with a gear 29. Gear 29 is rotatably journaled on an axle 31 which extends between bottom 15 and top 17. Driven gear 29 has a pinion gear 33 which meshes with a second gear 35 journaled on a second axle 37. Gear 35 drives a third gear 39, journaled on axle 31; and gear 39 drives a fourth gear 41 which is journaled on axle 37. Gears 35, 39, and 41 are similar to gear 29 in that each gear has an associated pinion gear 36, 40, and 42 respectively. The pinion gear of each gear meshes with its driving gear to be driven thereby (i.e., pinion gear 36 meshes with gear 39). Each gear, however, has a different gear ratio so that gear 41 rotates at a much slower rate than gear 29.

Figure 3:
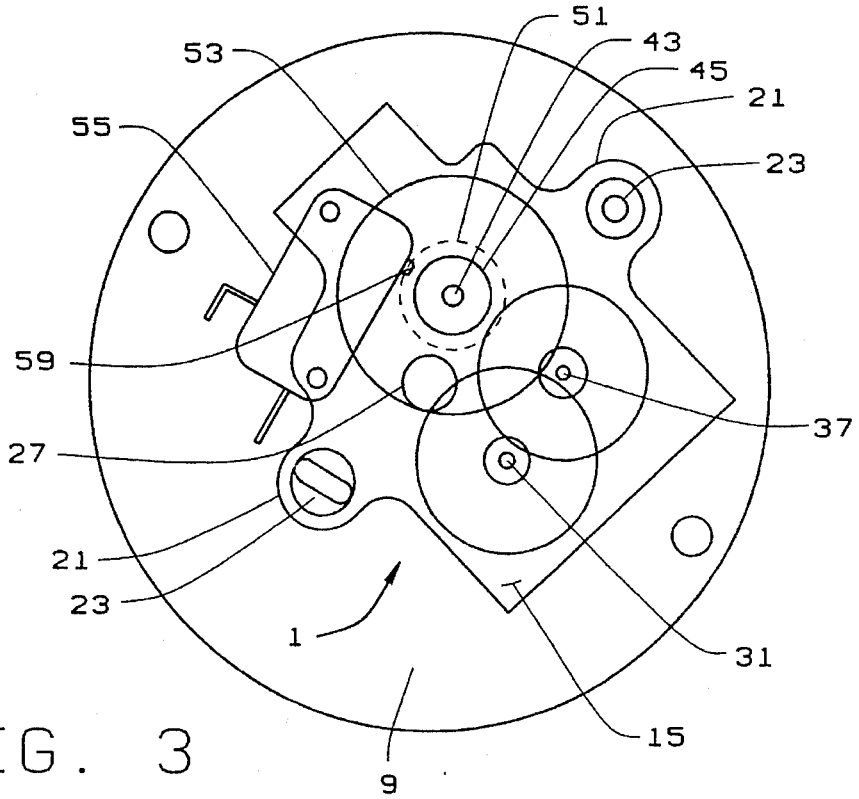
FIG. 3 is a plan view of the limit switch assembly secured to an end shield of the motor.

A third axle 43 extends between bottom 15 and top 17. A cam 45 having a pair of cam ears 47 and 49 is rotatably journaled on axle 43. Cam ears 47 and 49 are spaced apart, preferably by about 180°, and define a cam path 51 (FIG. 3). A gear 53 is rotatably journaled on axle 43 and is fixed to cam 45 so that cam 45 and gear 53 rotate together. Gear 53 meshes with pinion gear 42 to be driven thereby. Thus, cam 45 is rotated by rotor shaft 5, but at a much slower rate than the rotation of motor shaft 5.

Motor 3 is preferably a reversible motor and is connected to a pair of switches 55 and 57. Switches 55 and 57 are operably connected to the control circuitry of the motor. Each switch is a normally closed switch which breaks the circuit to stop the motor when actuated. Actuation of switch 55 prevents operation of the motor in one direction (clockwise, for example) and actuation of switch 57 prevents operation of the motor in the other direction (counterclockwise). Each switch has a switch button 59 and 61 which is positioned in housing 13 such that buttons 59 and 61 extend into the cam path 51. Switches 55 and 57 are secured in housing 1 in a stacked position. Cam buttons 47 and 49 are positioned on cam 45 so that cam ear 49 is at the same level as button 59 and ear 47 is at the same level as button 61 so that the cam ears will contact and depress the buttons to activate their respective switches as the cam is rotated. When cam 45 is rotated, one cam ear will depress one of the switch buttons to stop rotation of the motor in a first direction. The motor can then only be operated in a second, opposite direction. When operated in this second opposite direction, the other cam will depress the second switch to stop the motor from rotating in that direction. Limit switches 55 and 57 therefore operate to limit the number of rotations the rotor shaft can take in any one direction. By placing cam ears 47 and 49 180°apart on cam 45, the motor shaft will rotate the same number of times in each direction.

Figure 2:
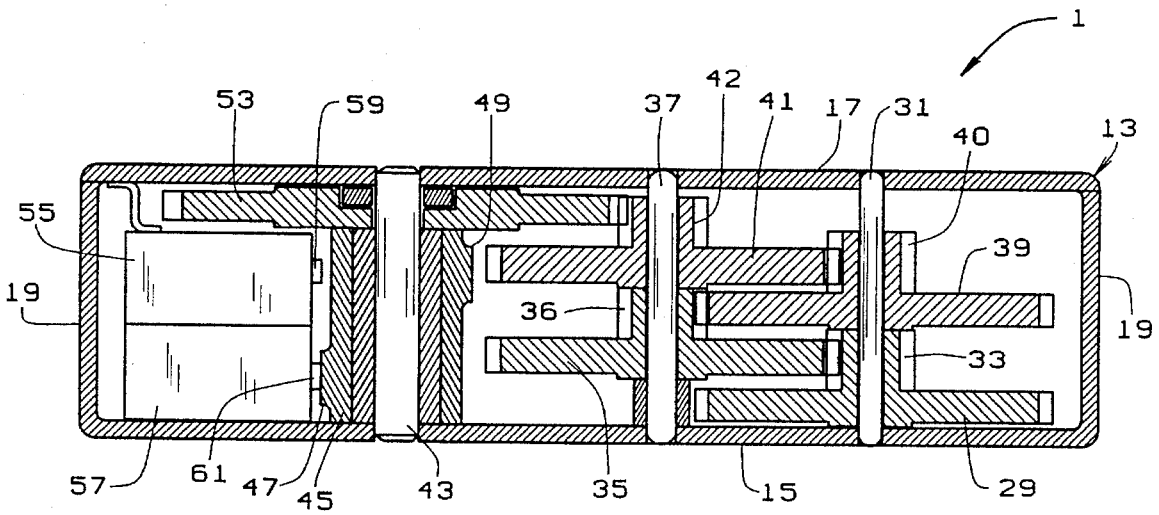
FIG. 2 is an enlarged cross-sectional view of the limit switch assembly of FIG. 1.
Figure 4:
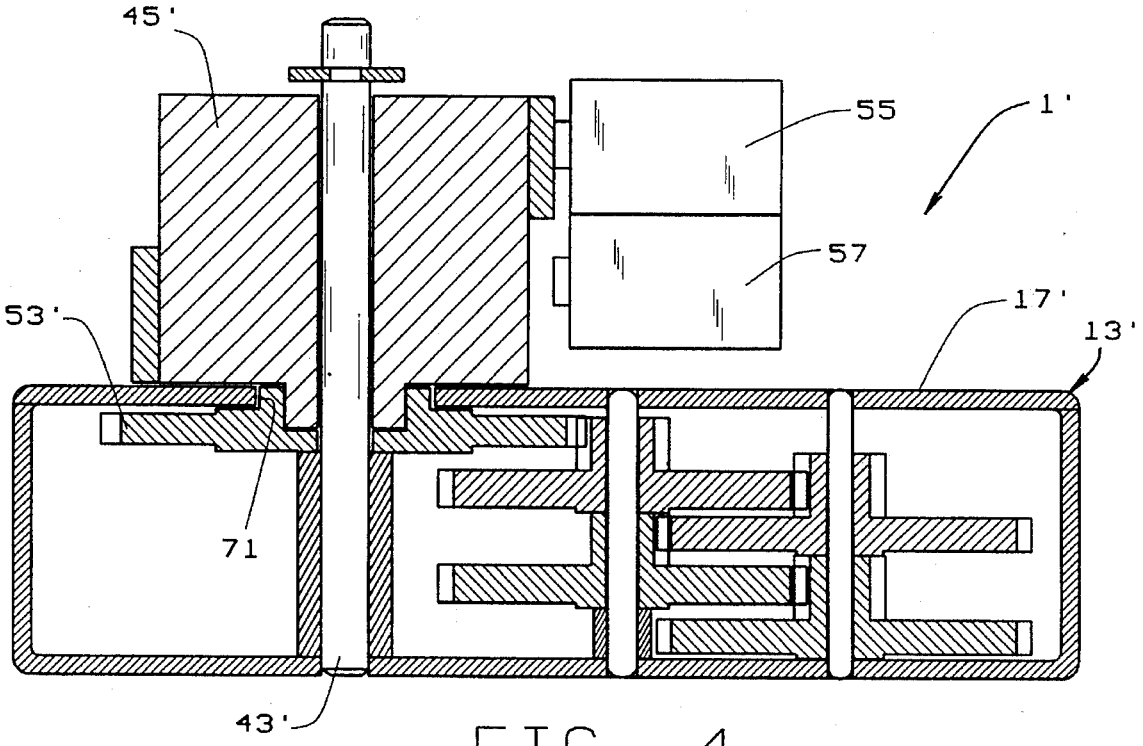
FIG. 4 is an alternate embodiment of the limit switch assembly of the present invention.
Figure 5:
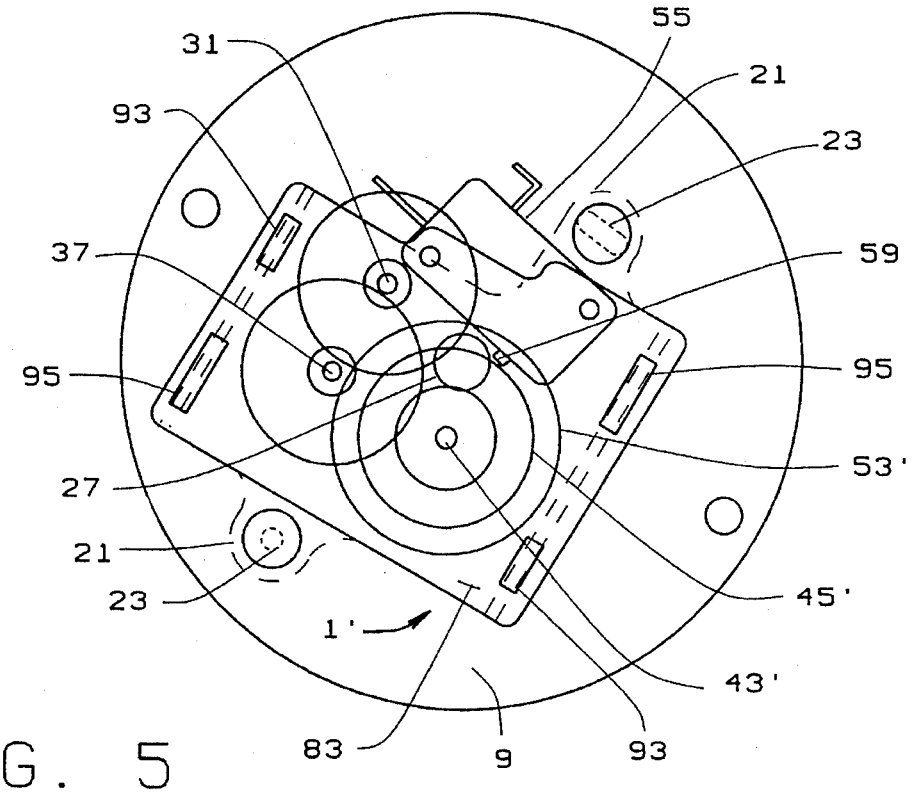
FIG. 5 is a plan view, similar to FIG. 3, of the limit switch assembly of FIG. 4.

An alternate configuration for the limit switch assembly of the present invention is shown in FIGS. 4 and 5. This assembly 1' is substantially similar to assembly 1 and includes a gear box 13' containing a plurality of gears driven by the rotor shaft gear and which drive an end gear 53'. However, limit switch assembly 1' has a cam 45 and switches 55 and 57 located above top 17', rather than inside of box 13' as in the assembly of FIGS. 1–3. In assembly 1', top 17' has an opening 71 through which axle 43' extends. Cam 45' is rotatably journaled on axle 43' to actuate limit switches 55 and 57.

Figure 6:
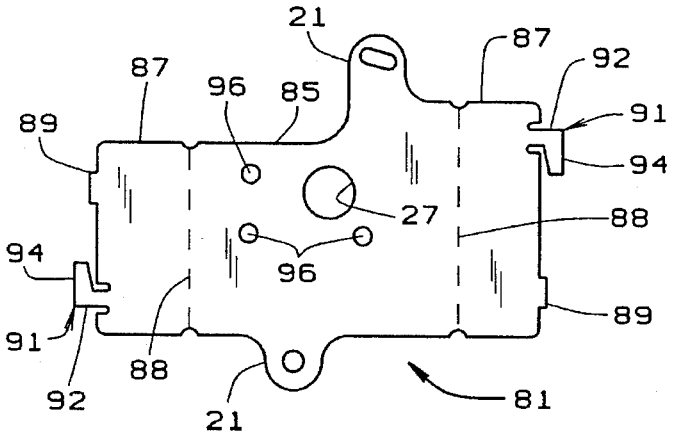
FIG. 6 is a plan view of a blank for bottom and sides of a housing for the limit switch assembly of FIGS. 4 and 5.
Figure 7:
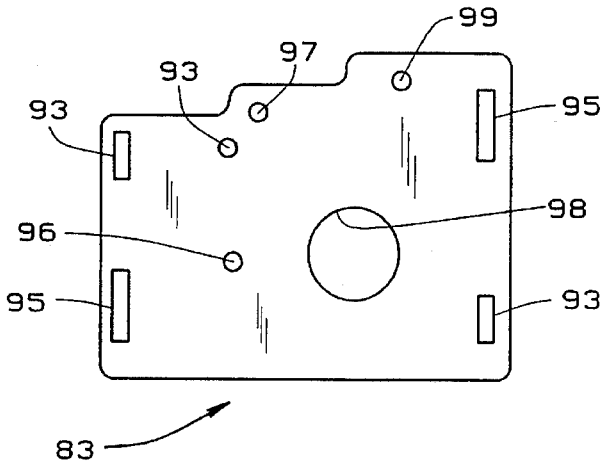
FIG. 7 is a plan view of a blank for the top of the limit switch assembly.

Turning to FIGS. 6 and 7, a blank 81 and a blank 83 are shown from which housing 13' is produced. Blank 81 has a middle section 85 which forms housing bottom 15 and two side portions 87 which form housing sides 19. Side portions 87 and middle portion 85 are separated by fold lines 88. Portions 87 have rectangular projections 89 and keys 91 formed in them. Keys 91 have a neck 92 and ears 94. Ears 94 are generally perpendicular to neck 91 and generally parallel to the edge of side portions 97. Blank 83 forms top 17' and has slots 93 which receive projections 89 and slots 95 which receive keys 91. Each blank has bores 96 which are positioned to receive axles 31 and 37. Blank 81 has a further bore 98 to receive axle 43. Bore 98 defines hole 71 in the assembly 1'.

To assemble the housing, side portions 87 are folded upwardly along fold lines 88 to form sides 19. Axles 31, 37, and 43 are then inserted into the bores in middle portion 85 and gears 29, 35, 39, 41 and 53 are installed on their associated axles. Top portion 83 is then placed on side walls 19 with the axles journaled in their respective bores to secure the axles in place. Top portion 83 is positioned such that slots 93 and 95 receive projections 89 and keys 91. Key ears 94 are then turned or rotated about their necks 92 to lock top 83 to the bottom 81. Axle 43 projects through opening 71 and cam 45' is secured thereon. Top 83 has two post holes 97 and 99 which receive positioning posts to fix limit switches 55 and 57 to top 83. This assembly is then secured to motor end shield 9 by driving screws through ears 21 of bottom 17 and into end shield 9. The assembly is positioned on end shield 9 such that motor gear meshes with rotor shaft gear 29 to operate cam 45'. The switch assembly may then be enclosed by a cover to protect the assembly from the environment in which the motor is placed.

The assembly of assembly 1 is substantially similar to that of assembly 1'. However, rather than placing the cam and limit switches on top of top 17, they are placed within the housing between top 17 and bottom 15. The blanks 81 and 83 which form the housing for assembly 1 will therefore be slightly different from that shown in FIGS. 6 and 7. In FIG. 1, the cam and limit switches are placed within the housing, thus hole 98 would not be formed in top blank 83, and positioning post holes would be provided in bottom 81 to position the limit switches.

Blanks 81 and 83 may be made of any suitable material, such as a malleable metal or plastic. If it were made of plastic, the axles and positioning posts could be formed in their proper places through a molding procedure. Alternately, the positioning posts could be eliminated and a bay or the like could be substituted therefor to properly position switches 55 and 57.

As can be appreciated, the limit switch assembly of the present invention is self contained and therefore can be applied to any motor. This eliminates the need to maintain an inventory containing both a motor with and a motor without a limit switch for each motor model to which a limit switch may be applied. Rather, all that is needed is a supply of the limit switch assemblies and a supply of the motors, and the limit switch assemblies can be optionally applied to the proper motor when needed. This therefore substantially reduces the motor inventory which must be retained by a manufacturer. Further, it allows for easy replacement of the limit switch should it fail. Replacement does not require the removal of the complete motor from its environment and the potential replacement of the complete motor assembly. Also, by making the housing of light metals or plastics, the cost of producing limit switch assemblies is substantially reduced.

The foregoing disclosure is set forth for illustrative purposes only. Variations, within the scope of the appended claims, may be apparent to those skilled in the art. For example, the cams 47 and 49 may be integral or separated. If formed as two pieces, the cams are to be fixed together so that they rotate together. The cam 45 may be integrally formed with gear 53. The sides could be formed with the top, rather than the bottom. If formed as two pieces, the cams are to be fixed together so that they rotate together. These examples are merely illustrative.

We claim:

1. A limit switch assembly for a motor, the motor having an end shield, an output shaft extending through said end shield, and a drive gear on said output shaft; the limit switch assembly including;

housing defining a gear box, said housing including a bottom attached to said end shield, and a top spaced from said bottom;

at least two gears housed in said gear box, a first gear of said at least two gears being a driven gear which meshes with said motor gear to be driven thereby, a second gear of said at least two gears meshing with said first gear of said at least two gears;

at least one cam operatively connected to said second gear to be rotated thereby, said at least one cam having a cam ear defining a cam path as said cam is rotated; and least one switch having a switch button located in said cam path so as to be depressed by said cam ear; said at least one switch being part of a circuit which supplies current to said motor, said at least one switch stopping the flow of current to said motor to stop said motor when said switch button is depressed;

said at least one cam and said at least one switch being housed within said gear box, and positioned between said top and said bottom;

said gear box at least two axles extending between said top and said bottom, said first gear being journaled on one of said at least two axles and said second gear being journaled on another of said at least two axles to be operatively connected to said first gear to be rotatably driven by said first gear.

2. The limit switch assembly of claim 1 wherein said at least one switch is a normally closed switch, said at least one switch being opened when said switch button is depressed.

3. The limit switch assembly of claim 1 wherein said at least one cam and said second gear are mounted on the same axle, said at least one cam being operatively connected to said second gear to be rotated thereby.

4. The limit switch assembly of claim 3 wherein said first gear includes a first pinion gear, said first pinion gear being operatively connected to said second gear to drive said second gear.

5. The limit switch assembly of claim 4 further including a third axle extending between said top and said bottom, said third axle having a third gear thereon which meshes with said first pinion gear, said third gear being operatively connected to said second gear to drive said second gear.

6. The limit switch assembly of claim 5 wherein said third gear includes a second pinion gear, said second pinion gear being operatively connected to said second gear to drive said second gear.

7. The limit switch assembly of claim 6 wherein said first and third axles each have more than one gear rotatably mounted thereon, said gears being interconnected and having different gear ratios to drive said second gear at a slower rate than the rate at which said rotor shaft rotates.

8. The limit switch assembly of claim 7, said gears journaled on said first and third axles each having an associated pinion gear, each gear being driven by the pinion gear of its driving gear.

9. A limit switch assembly for a motor, the motor having an end shield, an output shaft extending through said end shield, and a drive gear on said output shaft; the limit switch assembly including:

a housing attached to said motor, said housing defining a gear box, said housing including a first wall and a second wall spaced from said first wall;

at least two gears housed in said gear box, a first gear of said at least two gears being a driven gear which meshes with said motor drive gear to be rotatably driven thereby, a second gear of said at least two gears meshing with said first gear;

at least one cam operatively connected to said second gear so as to be rotated thereby, said at least one cam having a cam ear defining a cam path as said cam is rotated; and at least one switch having a switch actuator located in said cam path to be operated by said at least one cam; said at least one switch being part of a circuit which supplies current to said motor, said at least one switch stopping the flow of current to said motor in at least one position of said switch;

wherein said housing is defined by a first blank having a middle portion and side portions to define said first wall and sides, and a second blank to define said second wall, said blanks including means for securing said second wall to said sides;

said securing means comprising at least one key formed on at least one of said side portions of said first blank and at least one opening formed in said second blank which accepts said key; said key having a neck extending outwardly from said side portion and an ear formed on an end of said neck, said ear being rotatable on said neck to hold said second blank on said first blank.

10. The blank of claim 9 wherein said securing means further includes at least one projection formed on at least one of said side portions and at least one opening formed in said second blank to accept said at least one projection.

11. A blank for a limit switch assembly housing, said limit switch assembly housing being optionally securable to a motor, the motor having a rotor shaft with a drive gear thereon; said limit switch assembly housing having a first gear mounted on a first axle, a second gear driven by said first gear and mounted on a second axle, a cam rotated by said second gear, and a limit switch which is actuated by said cam, said blank having a first piece, a second piece, and means for securing said first and second pieces together;

said first piece including a middle portion defining a first surface of said housing, and two side portions defining sides of said housing;

said second piece defining a second surface of said housing;

one of said second piece and said middle portion of said first piece having a bore formed therein to receive said rotor shaft;

one of said first piece and said second piece defining bores to receive said axles.

12. The blank of claim 11 wherein said securing means comprises at least one key formed on at least one of said side portions of said first piece and at least one opening formed in said second piece which accepts said at least one key; said at least one key having a neck extending outwardly from said at least one side portion and an ear formed on an end of said neck, said ear being rotatable on said neck to hold said second piece to said first piece.

13. The blank of claim 12 wherein said securing means further includes at least one projection formed on at least one of said side portion formed in said second piece to accept said at least on projection.

14. The blank of claim 11 wherein said axles are integrally formed on the other of said first or second pieces, said axles and said bores being formed to be in alignment.

15. The blank of claim 11 wherein said other of said first and second pieces also has bores formed therein, said bores of said first and second pieces being aligned to support said axles in a position generally perpendicular to said first and second pieces.

16. In combination, a motor assembly and a limit switch assembly optionally mountable to the motor assembly;

the motor assembly including a stator, a rotor, a shaft extending from said rotor, and at least one end shield, said rotor extending from said at least one end shield and having a gear thereon;

said limit switch assembly including a first side mountable to said at least one end shield and a second side spaced from said first side; said first side defining a hole through which said rotor shaft gear extends; a first gear journaled on a first axis extending between said first and second sides, said first gear being driven by said rotor shaft gear; a second gear mounted on a second shaft extending between said first and second sides, said second gear being operatively connected to said first gear to be driven thereby; a cam operatively connected to said second gear to be rotated thereby; and at least one limit switch having a switch button, said switch button extending into a path defined by said cam to be actuated by said cam.

17. The combination of claim 16 wherein said first side includes a tab defining an opening; said opening receiving a fastener to secure said first side to said end shield.

18. The combination of claim 17 wherein said first side includes outwardly extending walls, said second side being securable to said walls.

19. The combination of claim 18 wherein said walls include an ear capable of being turned on a neck, said neck extending upwardly from said walls, said second side defining an opening which receives said ear and said neck, said ear being rotated about said neck to secure said second side to said first side.

20. The combination of claim 19 wherein said first and second sides define aligned bores, said first and second axles being journaled in said bores.

21. In combination, a motor assembly and a single limit switch assembly;

the motor assembly including a stator, a rotor, a shaft extending from said rotor, and at least one end shield, said rotor extending from said at least one end shield and having a gear thereon; and said limit switch assembly including a bottom side and a top side, said top side being spaced from said bottom side; said top and bottom sides defining a housing; a first axle and a second axle extending between said top and bottom sides, a first gear on said first axle to be in meshing contact with said motor shaft gear to be driven thereby, and a cam assembly mounted on said second axle, said cam assembly including a second gear which is driven by said first gear and a cam member rotationally fixed with respect to said second gear; said bottom side being removably securable to said at least one motor end shield to removably secure said limit switch assembly to said motor end shield.

22. The combination of claim 21 wherein said bottom side defines a hole through which said rotor shaft gear extends; said rotor shaft gear being received in said limit switch assembly housing; said limit switch assembly including:

a limit switch having a switch button, said switch button extending into a path defined by said cam such that the cam alters the position of said switch button; said limit switch being electrically connected to said motor, said limit switch stopping said motor when the cam member alters the position of said switch button.

* * * * *

UNITED STATES PATENT AND TRADEMARK OFFICE

CERTIFICATE OF CORRECTION

PATENT NO. : 5,506,377

DATED : April 9, 1996

INVENTOR(S) : Jason J. Hill, Stephen Nadler, and Stephen J. Burton

It is certified that error appears in the above-indentified patent and that said Letters Patent is hereby corrected as shown below:

Claim 1, Col. 5, line 34, after the word "box", insert the word ---including---.

Claim 13, Col. 7, line 5, change the word "portion" to ---portions---. Also on line 5, after the word "portions" and before the word "formed", insert the following words ---and at least one opening---, Claim 22, Col. 8, lines 34 and 35, after the word "cam", insert the word ---member---.

Signed and Sealed this

Thirtieth Day of December, 1997

Bruce Lehman

*Attest:*

BRUCE LEHMAN

*Attesting Officer*

*Commissioner of Patents and Trademarks*